US009509097B2

(12) United States Patent
Peckham

(10) Patent No.: US 9,509,097 B2
(45) Date of Patent: Nov. 29, 2016

(54) SAFETY ELECTRICAL OUTLET ARRANGEMENT

(71) Applicant: Albert E. Peckham, Gloucester, MA (US)

(72) Inventor: Albert E. Peckham, Gloucester, MA (US)

( * ) Notice: Subject to any disclaimer, the term of this patent is extended or adjusted under 35 U.S.C. 154(b) by 83 days.

(21) Appl. No.: 14/121,626

(22) Filed: Sep. 27, 2014

(65) Prior Publication Data

US 2016/0093981 A1 Mar. 31, 2016

(51) Int. Cl.
*H01R 13/44* (2006.01)
*H01R 13/639* (2006.01)
*H01R 13/447* (2006.01)

(52) U.S. Cl.
CPC ..... *H01R 13/6397* (2013.01); *H01R 13/447* (2013.01)

(58) Field of Classification Search
CPC ..... H01R 13/6397; H01R 13/447
USPC ..... 439/133, 304
See application file for complete search history.

(56) References Cited

U.S. PATENT DOCUMENTS 2,891,102 A * 6/1959 Grimes ..... H01R 13/447 174/481
2,987,909 A * 6/1961 Shlank ..... E05B 65/006 174/67
3,293,588 A * 12/1966 Blonder ..... H01R 13/6397 174/66
5,061,199 A * 10/1991 McClead ..... H01R 13/70 200/43.02
8,193,447 B2 * 6/2012 Peckham ..... H01R 13/447 174/50

* cited by examiner

*Primary Examiner* — Khiem Nguyen
(74) *Attorney, Agent, or Firm* — Don Halgren

(57) ABSTRACT

A lockout frame arrangement for an electrical outlet box arrangement, comprising an electrical outlet box arranged for receipt of electrical outlets;, a cover plate attachable to an open side of the electrical outlet box, for securement of electrical sockets therewithin, with a rectilinear outer cover capturing frame securely sandwiched between the cover plate and the open side of the electrical outlet box. An outer protective cover plate is matingly attached to and securable within a perimeter of the outer cover capturing frame.

16 Claims, 15 Drawing Sheets

50
44
40
54
22

50
52
46
58
46
52
44
22
42
40
54

SAFETY ELECTRICAL OUTLET ARRANGEMENT

BACKGROUND OF THE INVENTION

1. Field of the Invention

This invention relates to electrical outlet enclosures and more particularly to a housing arrangement which mates about such an electrical outlet to ensure control of an electrical plug with respect to the electrical outlet, and is based upon Provisional Application No. 61/960,927, filed Sep. 28, 2013, and is incorporated herein by reference in its entirety.

2. Discussion of the Art

In many industries it is often necessary to electrically lock out machinery during times of nonuse of that machinery or during its servicing. This is typically accomplished by encasing the plug in a closable plastic casing with a padlock receiving arrangement. A padlock or padlock hasp containing openings for a number of padlocks is then utilized to secure and prevent the plug from being accessed. Some problems with this approach include where an encased plug with a number of padlocks attached may be left lying on the floor and constitute a trip hazard, or an electrical cord may be displaced from its normal routing path, or the occasional theft of the expensive casing and a still exposed electrical outlet that may permit unauthorized use of an electrical device in the vicinity of the machine locked out, which was powered down as a safety procedure. There are also instances where it is desirable to lock out a single receptacle rather than locking a circuit breaker that may control more than one receptacle and thereby unnecessarily powering down other equipment that is in use on the same circuit.

U.S. Pat. No. 8,193,447, issued on 5 Jun. 2012, and incorporated herein by reference, partially addressed these problems by providing a means to lock a plug in an enclosure attached to a receiving plate which plate was secured to electrical receptacle recessed in a wall. The wall surface itself provided a means for stabilizing the entire enclosure assembly.

However there are many instances in commercial or industrial settings where electrical receptacles, especially large ones typically utilized in high-voltage applications, are mounted in metallic "handy-boxes", junction boxes, or other type of enclosures that are not flush with a wall surface. These enclosures mount externally on walls and beans next to machinery and sometimes they are hanging on cords from an overhead. Unlike flush mount type receptacles such as those utilized in residential settings and addressed in the aforementioned '447 patent, these handy-box enclosures do not have a means of securely attaching a cover receiving plate. This is due to the lack of a flat wall surface planar to the receptacle for stabilization of a receiving plate.

Most of these handy-boxes have metallic covers that are attached with two diagonally opposed screws to the metallic enclosure box. A standard receiving plate as used in the prior '447 patent recited hereinabove does not attached securely or flatly to either the metallic cover or an enclosure box.

It is thus an object of the present invention, to overcome the disadvantages of the prior art.

It is a further object of the present invention to provide a safety lockout arrangement which is utilizable for a variety of junction box and cover arrangements.

It is yet another object of the present invention to permit an arrangement where plugs are locked out of the receptacle while maintaining the normal routing path for the electrical cord.

It is yet a further object of the present invention to permit the receptacle to be locked out, eliminating any accidental secondary use of the electrical outlet while machinery servicing is being performed.

It is yet another object of the present invention to minimize the obstruction and trip hazard of electrical cords lying on the floor with one or more padlocks hanging off of the enclosure.

It is yet another object of the present invention to provide immediate and positive visual confirmation that a receptacle is locked out, without having to rely on a remotely located circuit breaker which may itself be incorrectly locked out.

It is a further object of the present invention to provide an enclosure protective cover which may be clear, to permit visual verification of plug status.

It is yet a further object of the present invention to provide a protective cover which is unusable by itself, thus minimizing the chance of theft.

It is a further object of the present invention to provide a universal receiving plate or frame member which can accommodate cover apparatus of nearly any configuration.

It is a further object of the present invention to provide a blanking type cover which may be used to prevent contamination and also prevent access to an electrical outlet or to prevent access to control buttons or switches thereadjacent.

It is a further object of the present invention to provide a cover which permits plugs to be securely disconnected and contained in a known position off of the floor during a wash-down treatment rather than leaving that plug lie on the floor and possibly becoming filled/compromised with a liquid.

It is yet a further object of the present invention to provide a cover which has internal interference features to prevent the cover from being utilized as a lock in device for live plugs.

It is yet a further object of the present invention to provide a cover arrangement which may be utilized with adapter plates to fit hanging pendant type or other type of electrical boxes which do not otherwise include an independent cover plate.

BRIEF SUMMARY OF THE INVENTION

The present invention comprises a safety lockout arrangement for "handy-box" type junction boxes and other electrical enclosures typically found in many industrial applications today. The safety lockout arrangement comprises a rectilinear protective cover capturing frame which mates against the opened side of a rectilinear junction box housing. The cover capturing frame has a recessed, radially inwardly directed inner flange having a central opening therewithin. A standard outlet cover is arranged to mate against the recessed inner flange. The standard outlet cover typically has a pair of cover securement bolts which are received through corner openings thereon which securement bolts pass through openings in the recessed inner flange of the cover capturing frame, and are threadedly secured into a threaded securement bolt receiving hole typically arranged on diagonal corners of the junction box.

The cover capturing frame may have one or preferably two or more cover receiving plate hasps arranged on adjacent sides of the cover capturing frame. The cover capturing frame has a peripheral shoulder disposed therearound. The peripheral shoulder has a plurality of spaced apart protective cover frame engagement slots/openings on one or preferably at least two sides thereof for engagement with side extending feet of a protective outer cover.

The assembly of a standard cover plate onto a standard junction box "sandwiches" the cover capturing frame therebetween. An outermost protective cover is then pivotably attachable and lockable to the face of the cover capturing frame. The protective outer cover will have a pair of spaced apart protective cover-engagement feet extending from one side thereof and that outer protective cover will have a protective cover hasp extending from an opposite side thereof. The spaced apart outer protective cover engagement feet will mate with the spaced apart protective cover frame engagement slots arranged on the shoulder of the cover capturing frame. The hasp on the protective outer cover will be matable with one of the one or more hasps arranged on adjacent sides of the cover capturing frame. By virtue of having two (or more) hasps on the sandwiched cover capturing frame permits selecting the securement orientation of the protective outer cover relative to the sandwiched cover capturing frame and its associated junction box.

The entire assembly for such a handy box lockout arrangement thus comprises the standard junction box which may be securable to a wall or planar surface, with the cover frame arranged against its open face, and held at that location by a standard cover plate which typically exposes the electrical outlets. The assembly also includes a pivotably securable protective outer cover which is anchored to the cover capturing frame along one edge thereof and is lockable to that cover capturing frame on an opposite edge thereof by a padlock securing the hasp of the protective cover to one of the selected hasps on the sandwiched cover capturing frame.

The invention thus comprises a lockout frame arrangement for an electrical outlet box arrangement, comprising: an electrical outlet box arranged for receipt of electrical outlets; a standard cover plate attachable to an open side of the electrical outlet box, for securement of electrical sockets therewithin; a rectilinear outer cover capturing frame securely sandwiched between the standard cover plate and the open side of the electrical outlet box; an outer protective cover plate matingly attached to and securable within a perimeter of the outer cover capturing frame.

The outer cover capturing frame has one or preferably at least two hasps extending outwardly from different frame portions thereof. The outer cover capturing frame has a plurality of spaced apart notches in a shoulder portion thereof. The outer protective cover preferably has a pair of foot tabs extending therefrom on a first side. The outer protective cover has a hasp extending therefrom on a second side opposite from the first side. The outer protective cover has an inner surface shaped and dimensioned so as to prevent mating of a plug with an outlet when that outer protective cover is secured in place on the outer cover capturing frame.

The outer protective cover may also comprise a pair of U-shaped pivotable lockout frame members pivotally attached by spaced apart pivot axes, to an inside shoulder of the outer cover capturing frame. Each of the U-shaped pivotable lockout frame members have a hasp on their outermost ends. The distance apart between adjacent spaced apart pivot axes is smaller than the diameter of an electrical plug to be utilized therewith.

The invention may also comprise a method of enabling the lockout of an electrical plug from an electrical junction box, comprising one or more of the steps of placing an outer cover-capturing-frame onto an open side of the electrical junction box; securing a standard junction box cover to the junction box while sandwiching the outer cover-capturing-frame therebetween; and pivotally placing an outer protective cover into engagement with the outer protective cover-capturing-frame so as to eliminate room for an electrical plug to be mated into a socket within the electrical junction box.

The method may include placing a hasp on a first side of the outer protective cover, placing one or two hasps extending from contiguous sides of the cover-capturing-frame to enable selective orientation of an outer protective cover thereon, placing a lock between one of the hasps on the outer protective cover-capturing-frame and the hasp on the outer protective cover so as to secure them together and prevent misuse of the electrical junction box, placing a set of foot tabs on a second side of the outer protective cover to enable the protective outer cover to be secured by its second side to the outer protective cover-capturing-frame.

The invention may also comprise an electrical junction box lockout system arranged to prevent misuse of a junction box comprising: an electrical junction box; a one or double-hasp configured outer protective cover-capturing-frame positioned onto an open end of the junction box; a standard junction box cover plate secured to the electrical junction box, sandwiching the outer protective cover-capturing-frame therebetween; and a hasp-configured, electrical-plug-crowding, outer protective cover secured from a first side thereof to a side of the cover-capturing frame.

The outer protective cover may have an internal electrical plug interfering surface thereon. The outer protective cover may have an external scratch resisting pattern of raised ribs thereon.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 1:
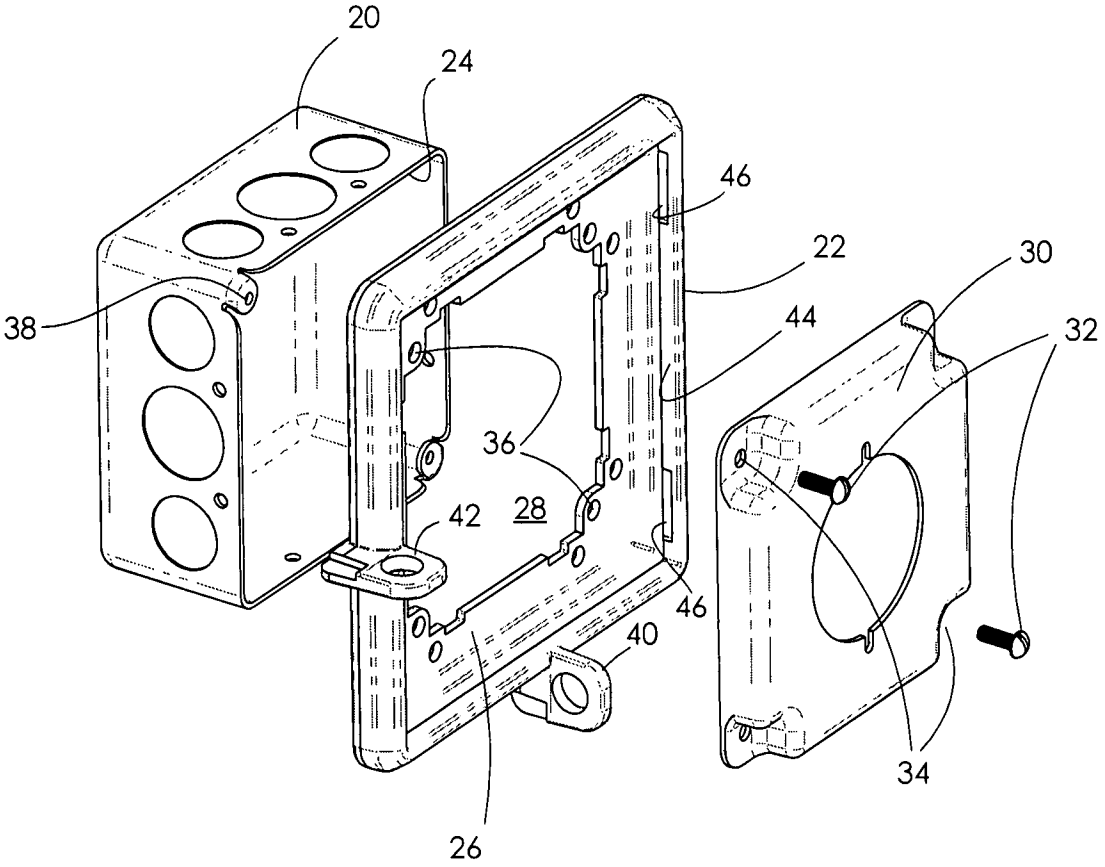
FIG. 1 is an exploded view of a junction box, a cover capturing frame and a standard cover prior to a protective outer cover being assembled therewith.
Figure 2:
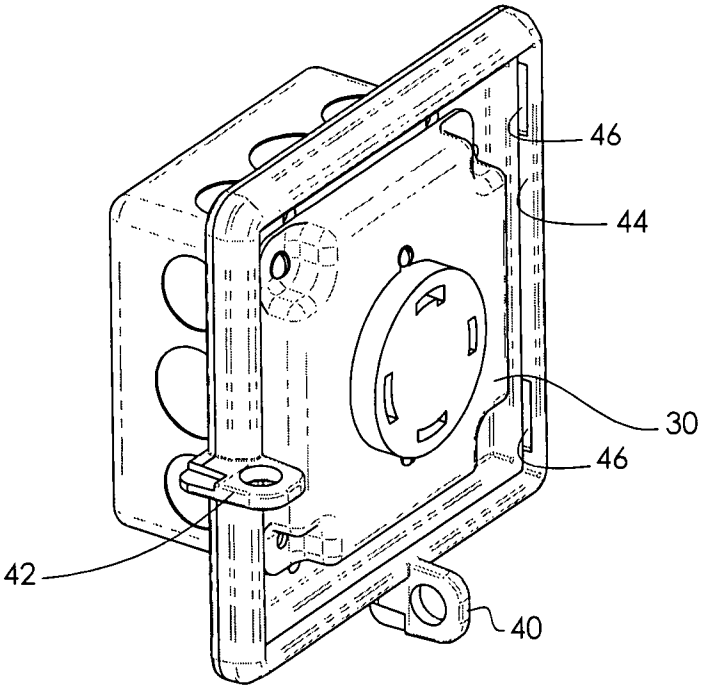
FIG. 2 is a perspective view of the junction box, the cover capturing frame and the standard cover assembled together exposing an electrical outlet centrally therewithin.
Figure 3:
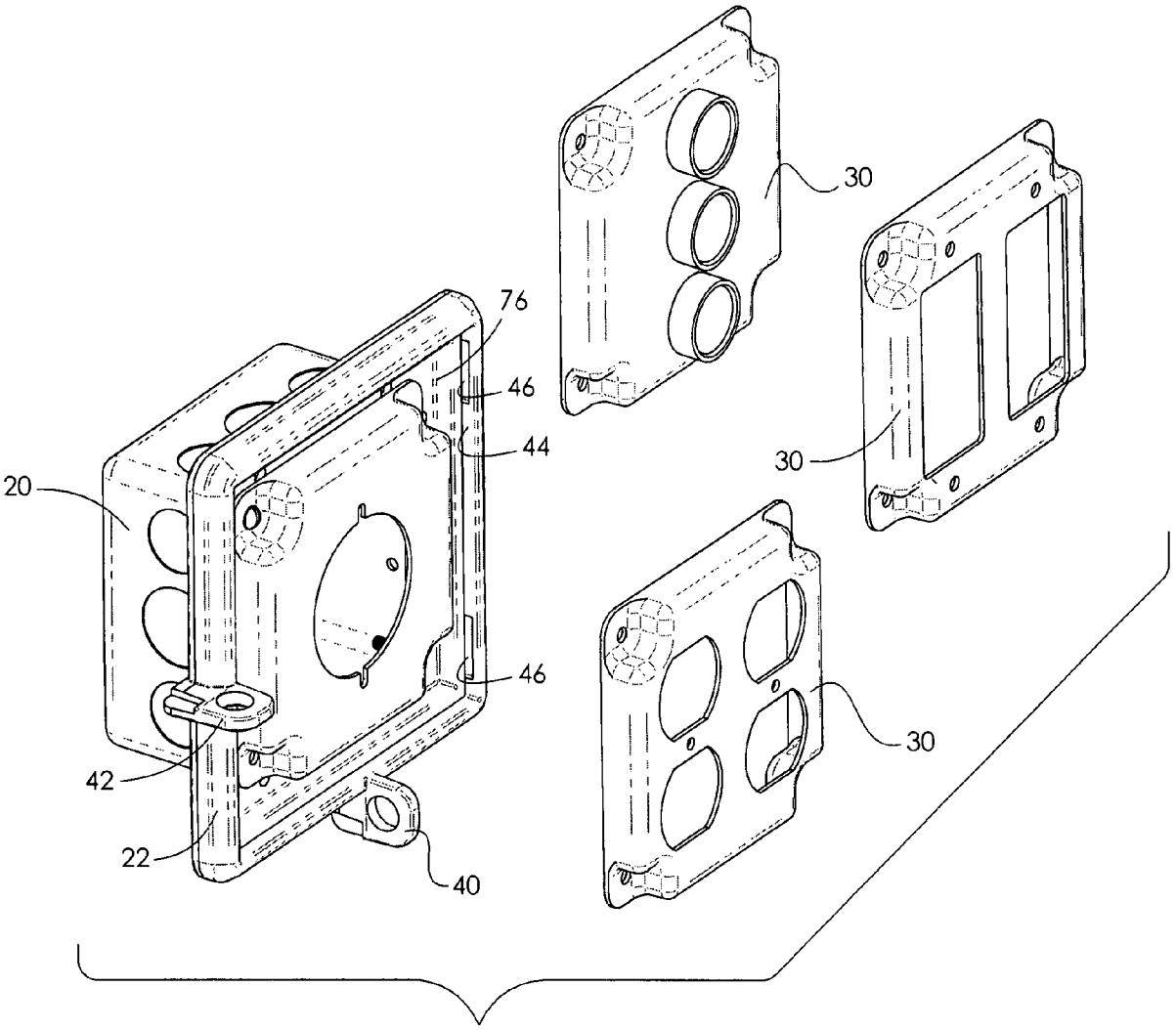
FIG. 3 is a perspective view of the junction box shown in FIG. 2, displaying other standard covers which may be adaptable and mated to the junction box.

Referring now to the drawings in detail, beginning particularly to FIG. 1, there is shown the present invention which comprises a safety lockout arrangement for "handy-box" type junction boxes 20 and other electrical enclosures typically found in many industrial applications today. The safety lockout arrangement comprises a rectilinear outer protective-cover-capturing frame 22 which mates against the opened side 24 of a rectilinear junction box housing 20. The cover capturing frame 22 has a recessed, radially inwardly directed inner flange 26 having a central opening 28 therewithin, as may be seen in FIGS. 1, 5, 8, 10, 12, 15A and 15B. A standard outlet cover 30 is arranged to mate against the recessed inner flange 26, as represented in FIGS. 1 and 2. The standard outlet cover 30 typically has a pair of cover securement bolts 32 which are received through corner openings 34 thereon, which securement bolts 32 pass through openings 36 in the recessed inner flange 26 of the cover capturing frame 22, and are threadedly secured into a threaded securement bolt receiving hole 38 typically located on diagonal corners of the junction box 20, as represented in FIGS. 1, 2 and 3.

The cover capturing frame 22 may have one or preferably at least two cover receiving plate hasps 40 and 42 arranged on adjacent sides of the cover capturing frame 22, as may be seen in FIGS. 1, 2, 3, 4A, 4B, 5, 6, 7, 8, 9A, 9B, 10, 11A, 11B, 12, and 13A. The cover capturing frame 22 has a peripheral shoulder 44 disposed therearound. The peripheral shoulder 44 has a plurality of spaced apart protective cover frame engagement slots 46 on at least two sides thereof for engagement with an outer protective cover 50.

The assembly of a standard (typical) cover plate 30 onto a standard (typical) junction box 20 "sandwiches" the cover capturing frame 22 therebetween, as represented in FIGS. 4A, 4B, 7, 9B and 13A. The outermost protective cover 50, is then insertably mated and pivotably attachable and lockable to the face of the perimeter shoulder 44 of the cover capturing frame 22, as represented in FIGS. 4A, 4B, 5, 6, 7, 8, 9A, 9B.

Figure 5:
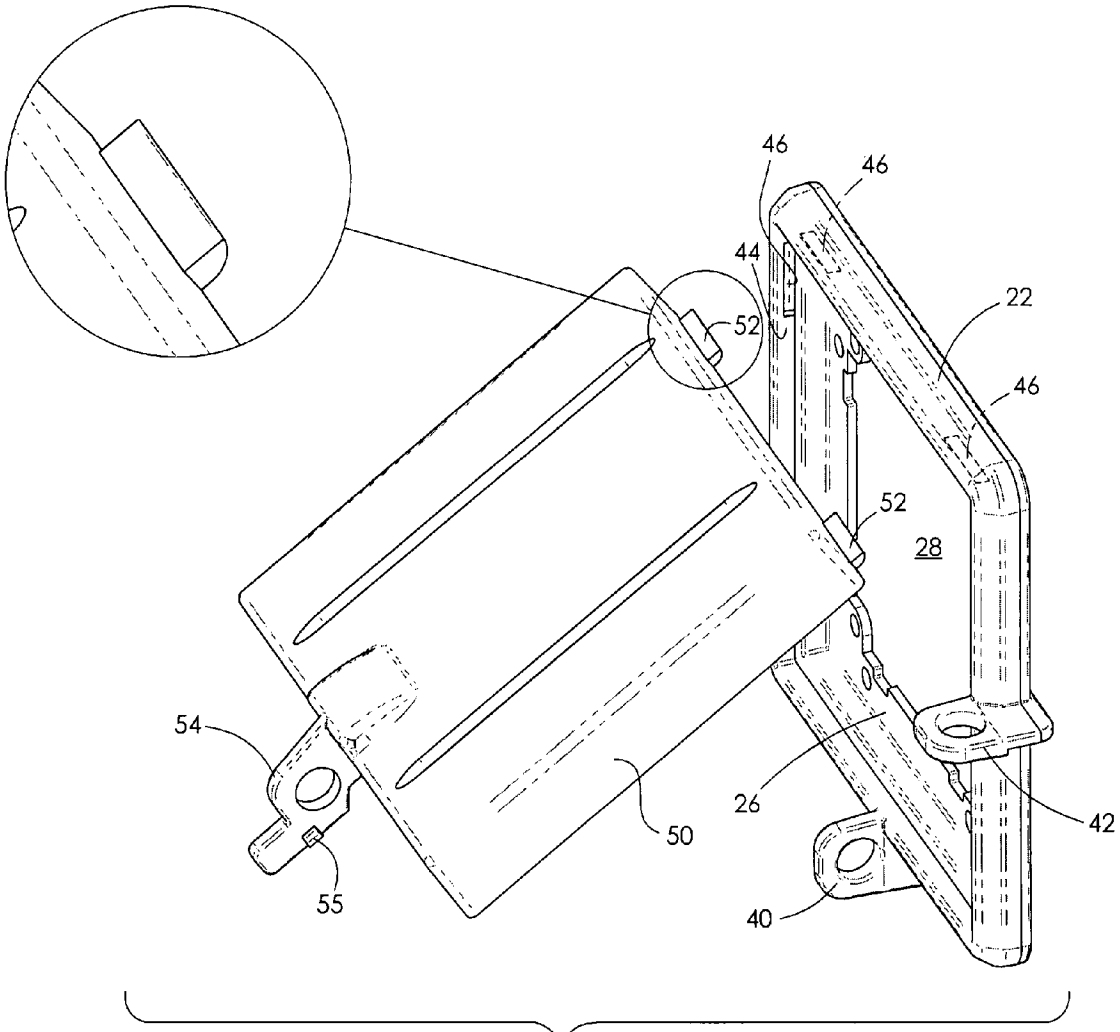
FIG. 5 is an exploded view of a cover receiving frame and a protective outer cover showing the exemplary structural details thereof.
Figures 6, 6A:
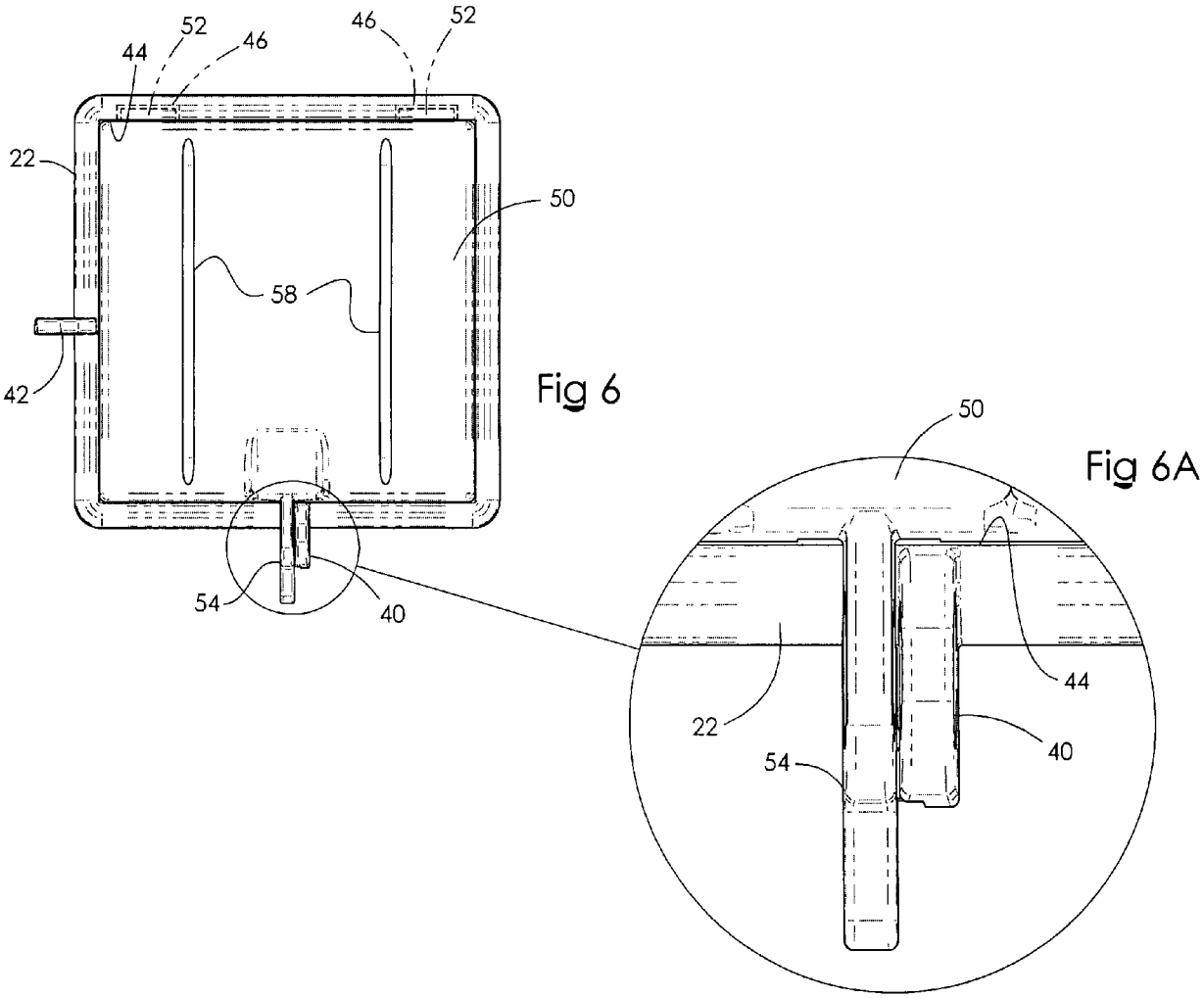
FIG. 6 is a plan view of the protective outer cover and cover capturing frame, represented in FIG. 5, now shown assembled there together.
FIG. 6A is an enlarged view of the hasps of the protective cover and the cover capturing frame.
Figure 8:
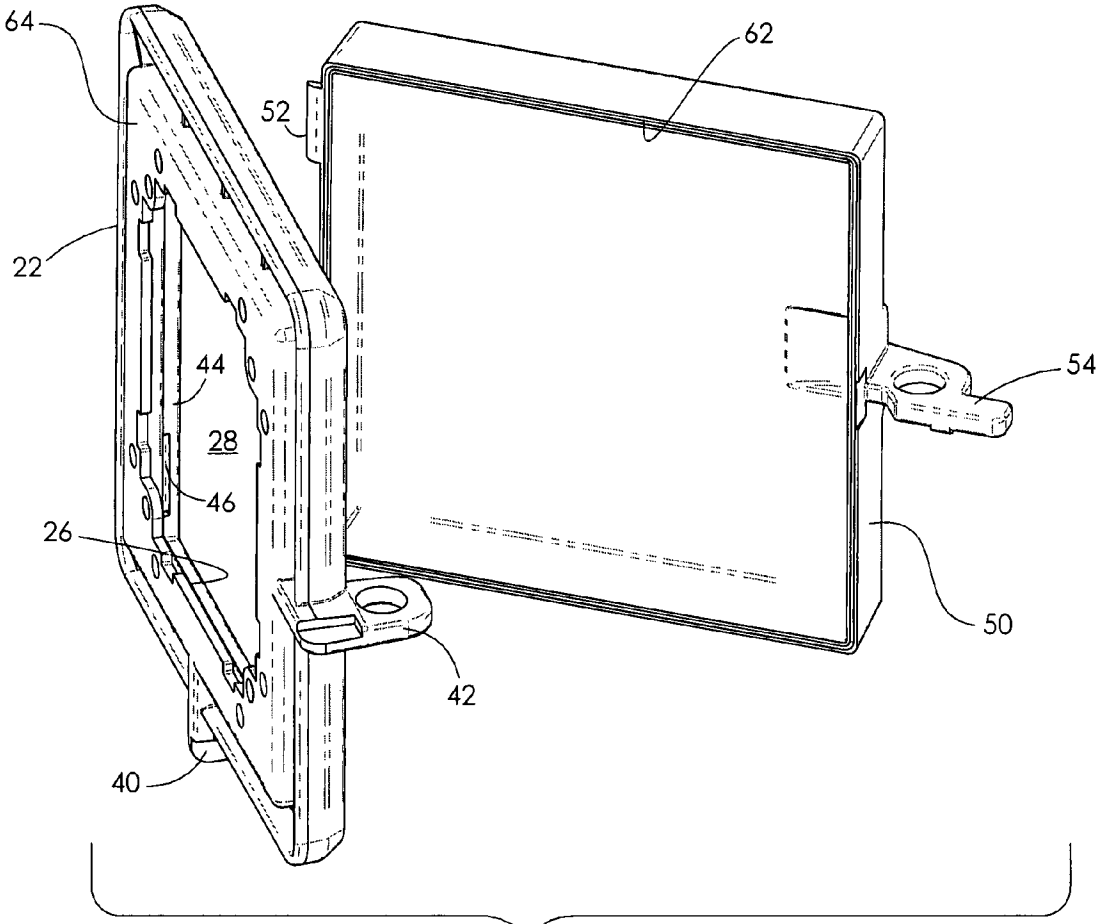
FIG. 8 is a perspective view of a protective cover and protective cover capturing frame prior to their assembly, showing a rear side of the protective cover frame.

The protective outer cover 50, will preferably have a pair of spaced apart protective cover-engagement feet 52 extending from one side thereof, as may be seen in FIGS. 5, 6 and 8, and that outer protective cover 50 will have a protective cover hasp 54, extending from an opposite side thereof, as exemplarily represented in FIG. 5. The spaced apart protective cover engagement feet 52 will mate with the spaced apart protective cover frame engagement slots 46 arranged on the shoulder 44 of the cover capturing frame 22. The hasp 54 on the protective outer cover 50 will be matable with one of the at least two hasps 40 or 42 arranged on adjacent sides of the cover capturing frame 22. By virtue of having two hasps 40 and 42 extending outwardly from adjacent sides of the sandwiched cover frame 22 as shown in FIG. 1, permits selecting the securement orientation (eg. 6 o'clock or 9 o'clock) of the protective outer cover 50 relative to the sandwiched cover frame 22 and its associated junction box 20.

Figure 4B:
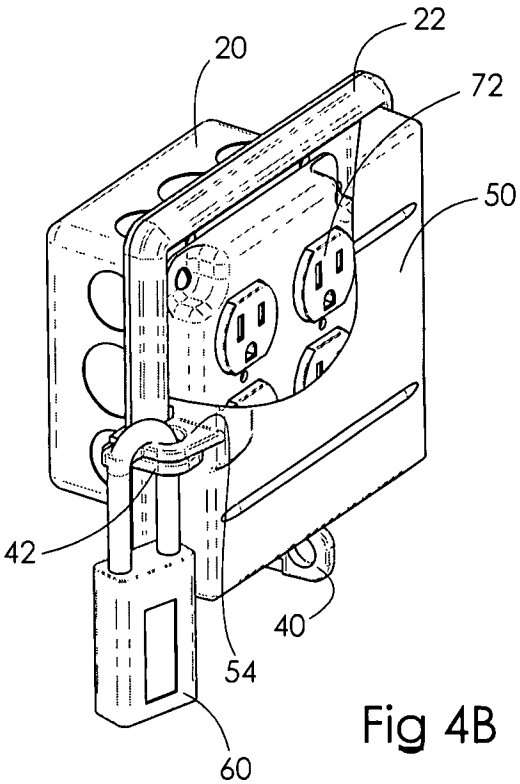
FIG. 4B is a perspective view of a junction box similar to that shown in FIG. 4A with the hasp of the protective cover secured to a hasp of the cover capturing frame at the 9 o'clock orientation.

The entire assembly for such a handy box lockout arrangement thus comprises the standard junction box 20 which may be securable to a wall or planar surface, with the cover capturing frame 22 arranged against its open face 24, and held at that location by a standard cover plate 30, which typically exposes the electrical outlets 58, as may be seen in FIG. 4B. The assembly also includes a pivotably securable protective outer cover 50 which is anchored to the cover capturing frame 22 along one edge thereof and is lockable to that cover frame 22 on an opposite edge thereof by a padlock 60 securing the hasp 54 of the protective outer cover 50 to one of the selected hasps 40 or 42 on the sandwiched (outer) cover capturing frame 22, as represented in FIGS. 4A, 4B, 9A, 9B, 13A, and 13B.

Figure 4A:
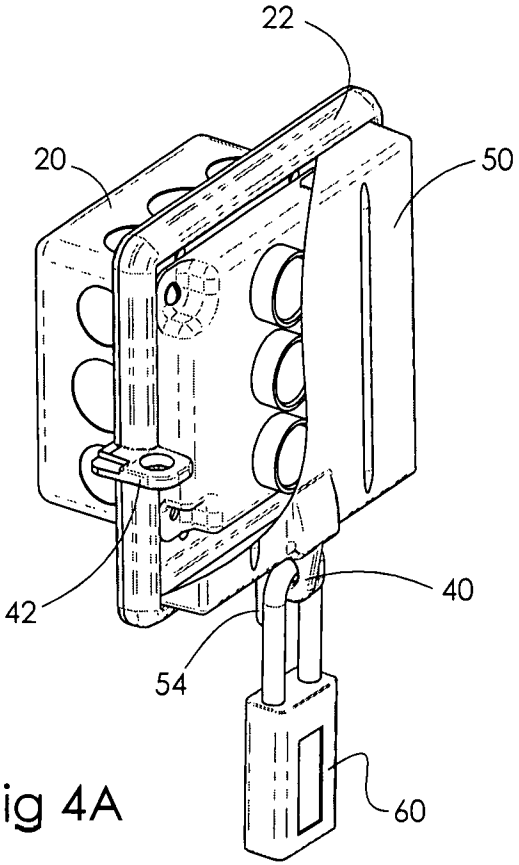
FIG. 4A is a perspective view of a junction box with the cover capturing frame, a standard cover plate and an outer protective cover, with portions cut away, secured to a hasp in the 6 o'clock orientation.
Figures 7, 7A:
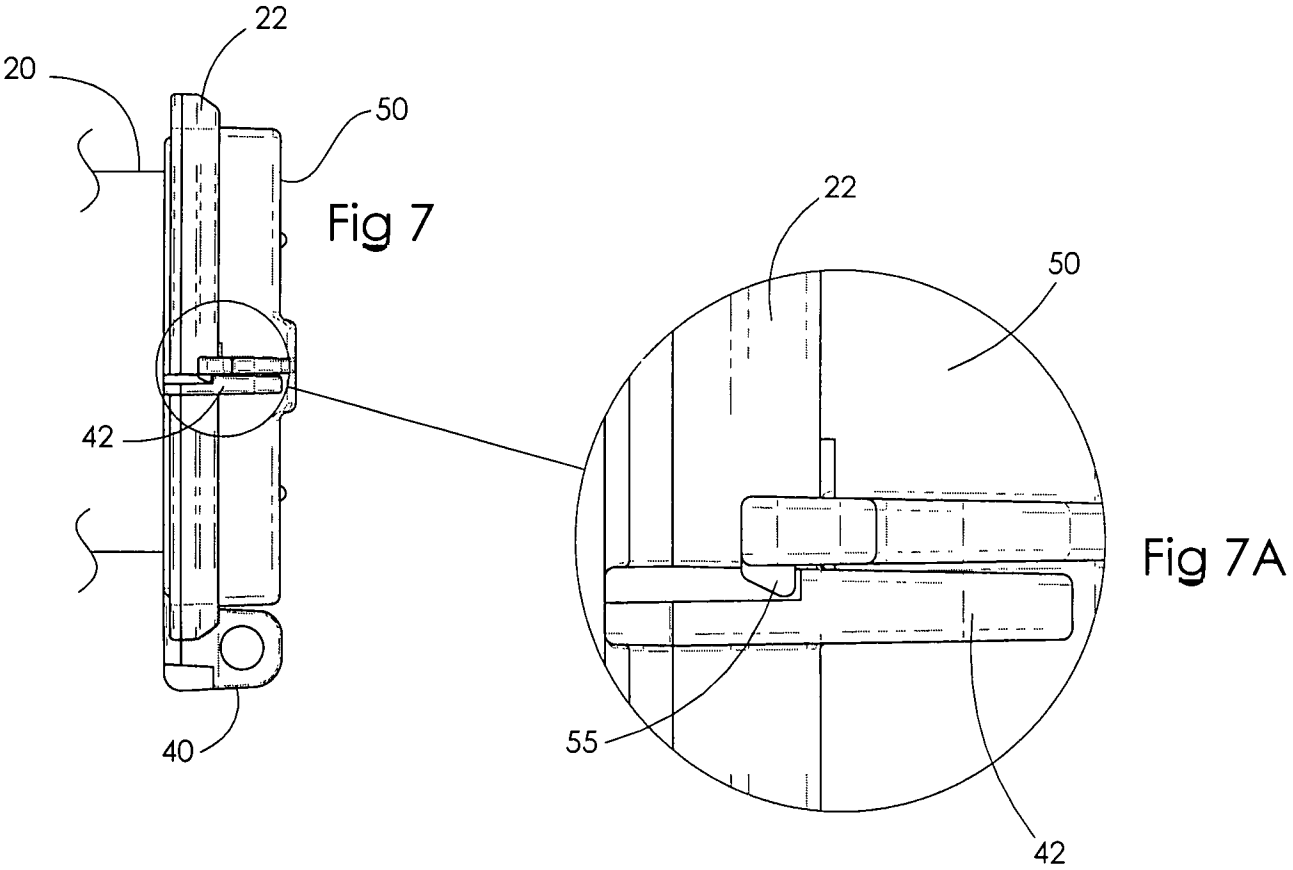
FIG. 7 is a side view of the assembly shown in FIG. 6.
FIG. 7A is an enlarged view of the edge of a pair of hasps between the cover capturing frame and the protective cover.

It is to be noted that in FIG. 3, three separate standard cover plates are shown which could be individually attachable to the cover capturing frame 22. FIG. 4A and FIG. 4B show the outer protective cover 50 in a cutaway representation. It is also be noted that in FIG. 4A and FIG. 4B, the hasp 54 from the protective outer cover 50 is attached to respectively different hasps 42 and 40 respectively on the cover capturing frame 22. FIG. 5 shows an exploded view of the feet 52 of a protective cover 50 about to be inserted into the slots 46 on the shoulder portion 44 of a cover capturing frame 22. The opposite side of the outer protective cover 50 from the feet 52, is shown with a hasp 54 thereon with a side tab 55 for engagement with a notch on either flange 40 or 42 of the cover capturing frame 22. FIG. 7A is an enlarged view of the edge representation of FIG. 7 showing the outer protective cover 50 with a hasp and its shoulder engaging finger engaging a shoulder on the hasp 42 of the outer cover capturing frame 22.

FIG. 6 represents a planar outer protective cover 50 with a plurality of elongated ribs 58 disposed thereon. The ribs 58 minimize any scratching that the outer cover 50 may otherwise encounter, which is particularly desirable if that outer cover 50 is transparent. FIG. 8 is an exploded representation of an outer protective cover 50 about to engage the cover capturing frame 22, wherein the protective cover 50 may have a gasket 62 around its perimeter for sealing purposes.

A further gasket 64 may be arranged on the inwardly directed side of the flange 26 of the cover capturing frame 22.

Figure 9B:
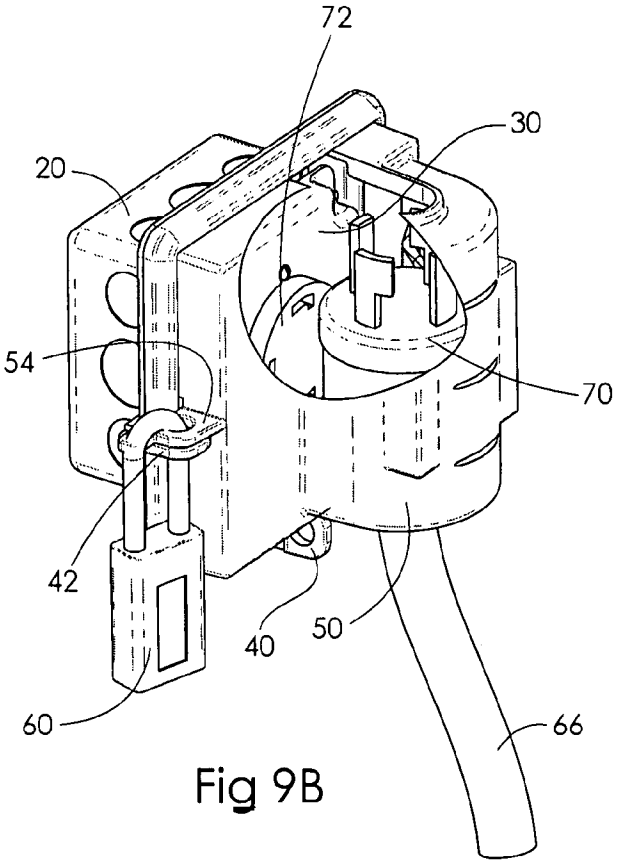
FIG. 9B is a perspective view similar to that shown in FIG. 9A with the protective cover oriented 90° away from that shown in FIG. 9A.
Figure 9A:
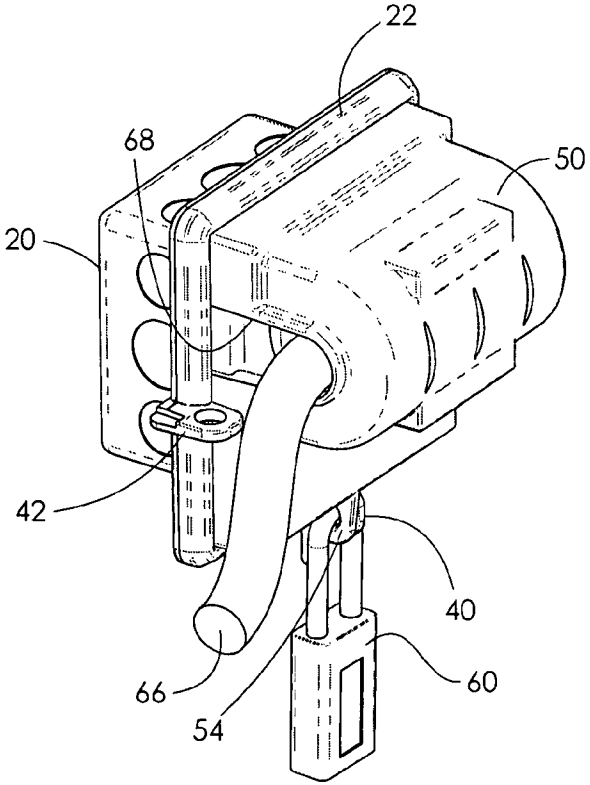
FIG. 9A is a perspective view of a lockout arrangement with an outer protective cover oriented with a plug wire extending into a side direction therefrom.

FIG. 9A shows a protective cover 50 mounted against a cover capturing frame 22 with a cord or plug wire 66 extending from a side opening 68 of the outer protective cover 50. FIG. 9B shows the protective cover 50 with a cutaway portion showing a plug 70 captured within the outer protective cover 50 and being prevented from electoral connection with an outlet 72 arranged within the cover plate 30. The dimension of the outer protective cover 50 is such as to deny the ability of an electrical plug 70 to be electrically utilized within that cover 50 while that cover 50 is secured to the cover capturing frame 22.

Figure 10:
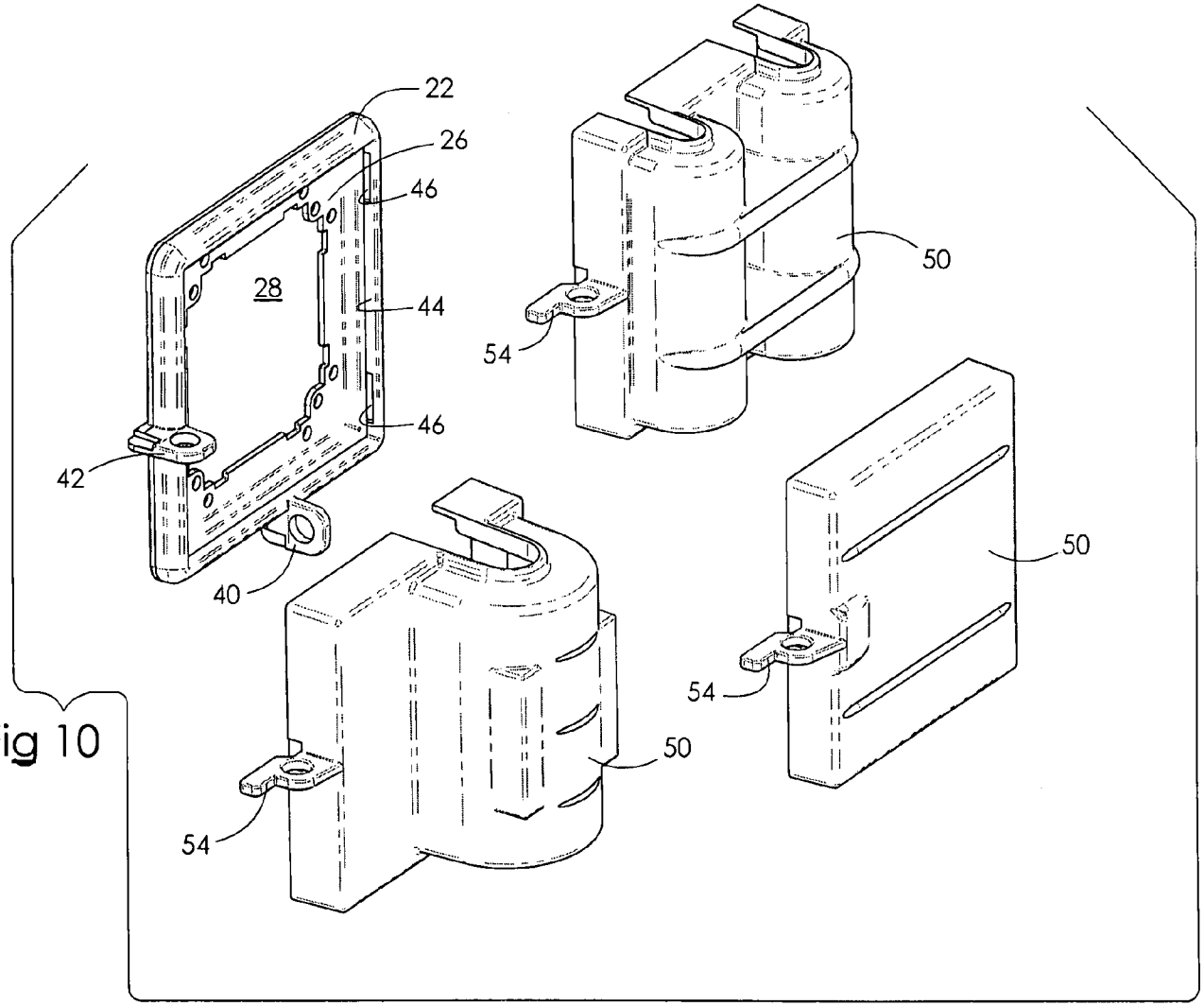
FIG. 10 is a view showing a cover capturing frame and a number of exemplary outer protective covers which may be matable therewith.
Figure 11B:
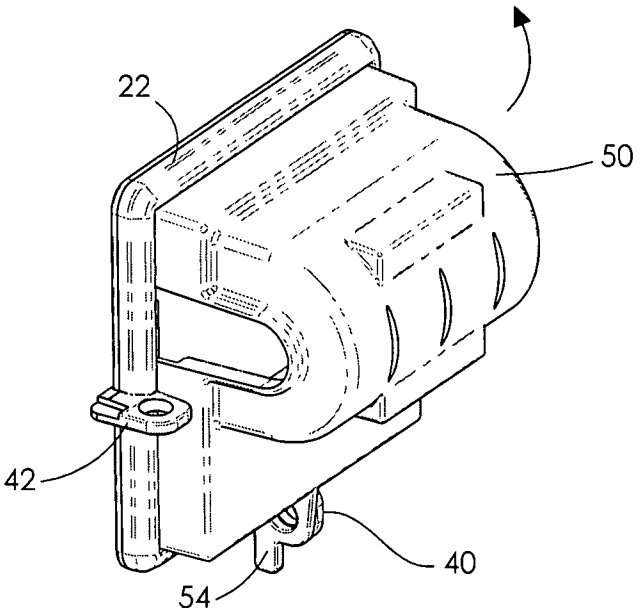
FIG. 11B is a perspective view of an outer protective cover snapped onto the cover receiving frame in a horizontal orientation.
Figure 11A:
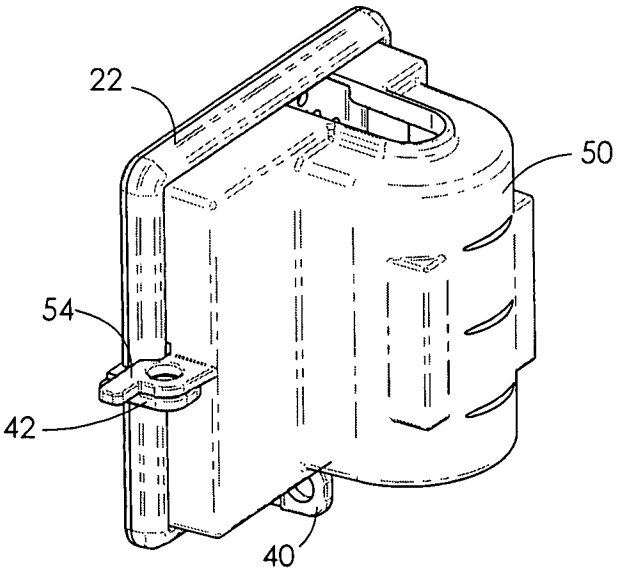
FIG. 11A is a perspective view of an outer protective cover snapped onto the cover capturing frame in a vertical orientation.
Figure 12:
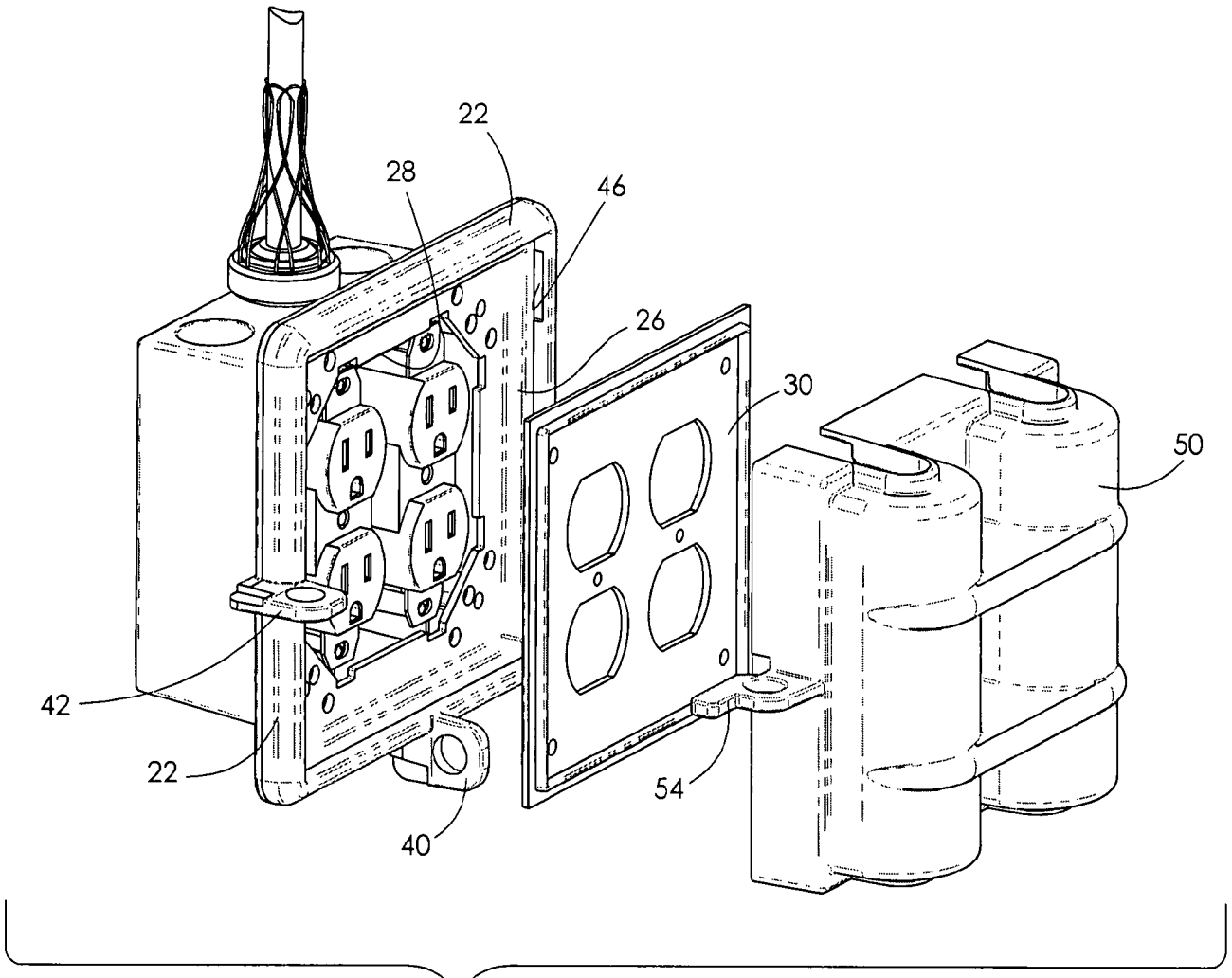
FIG. 12 is an exploded view of a junction box with a power cable therewith in a series of outlets therewithin surrounded by a cover receiving or capturing frame and a standard box cover plate and an outer protective cover therewith.

FIG. 10 represents a cover receiving or capturing frame 22 shown with a variety of utilizable protective covers 50, which could be matable therewith, one at a time. FIGS. 11A and 11B show the protective cover 50 snapped onto the cover capturing frame 22 in two different orientations, so as to permit electrical cord, not shown, to exit for example, from the top or bottom, or from the left or the right.

Figure 13B:
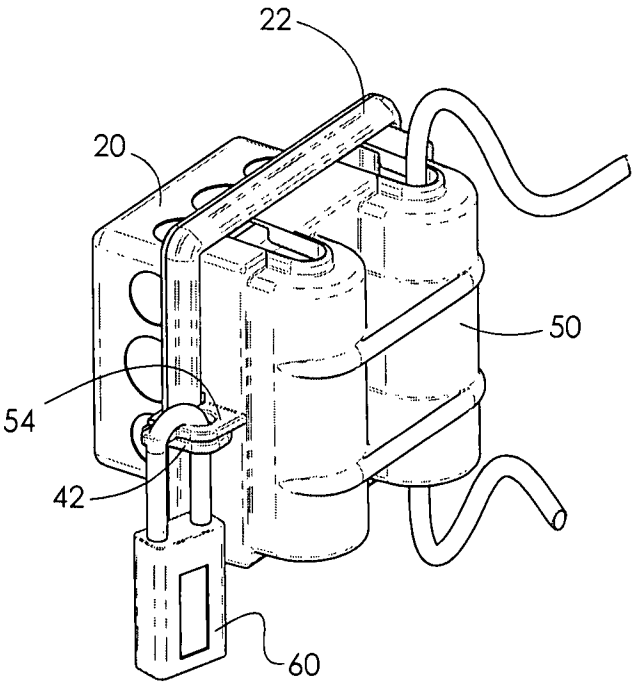
FIG. 13B is a view similar to that of FIG. 13 a with the protective cover in a vertical orientation.
Figure 13A:
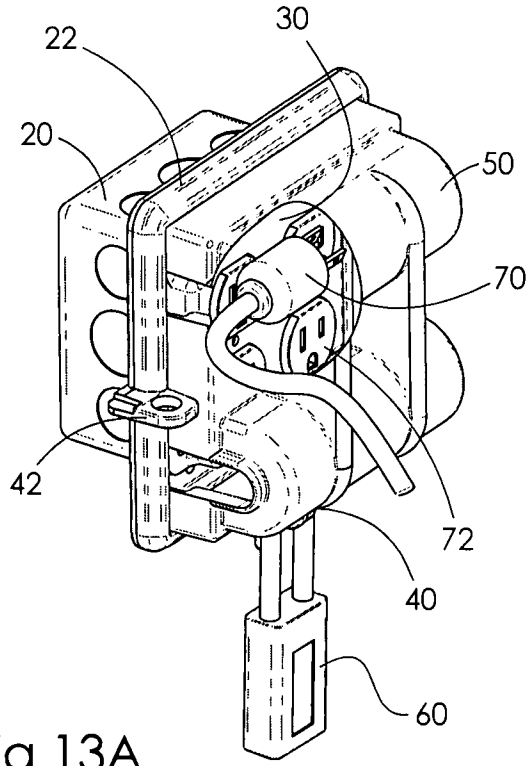
FIG. 13A is an assembly similar to that shown in FIG. 12 with the protective cover in a horizontal orientation.

FIG. 13A shows a protective outer cover 50 with a portion cut away, showing electric plug 70 within the protective outer cover 50, yet also maintained without electrical contact with the electrical outlets 72 within the inner cover plate 30.

Figure 14B:
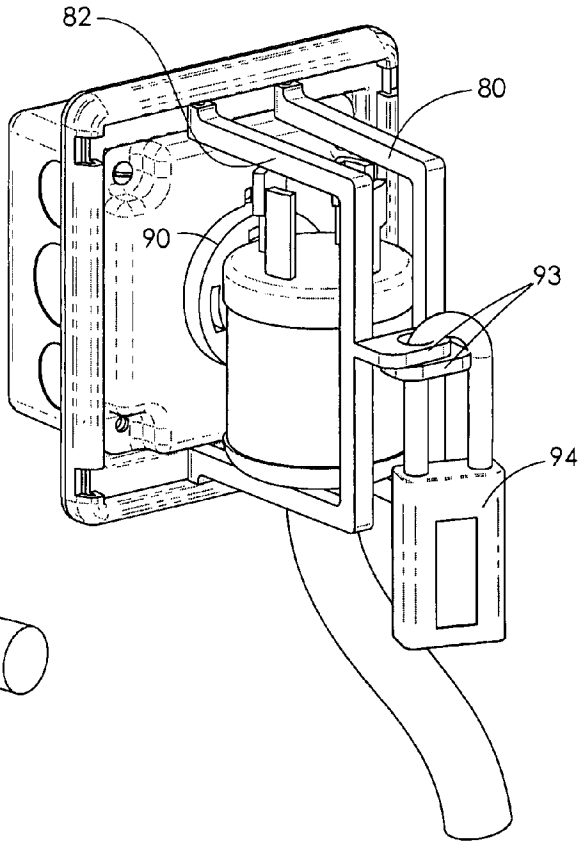
FIG. 14B is a perspective view of the junction box with the U-shaped pivot lockout frames blocking out a plug from a receptacle within that junction box.
Figure 14A:
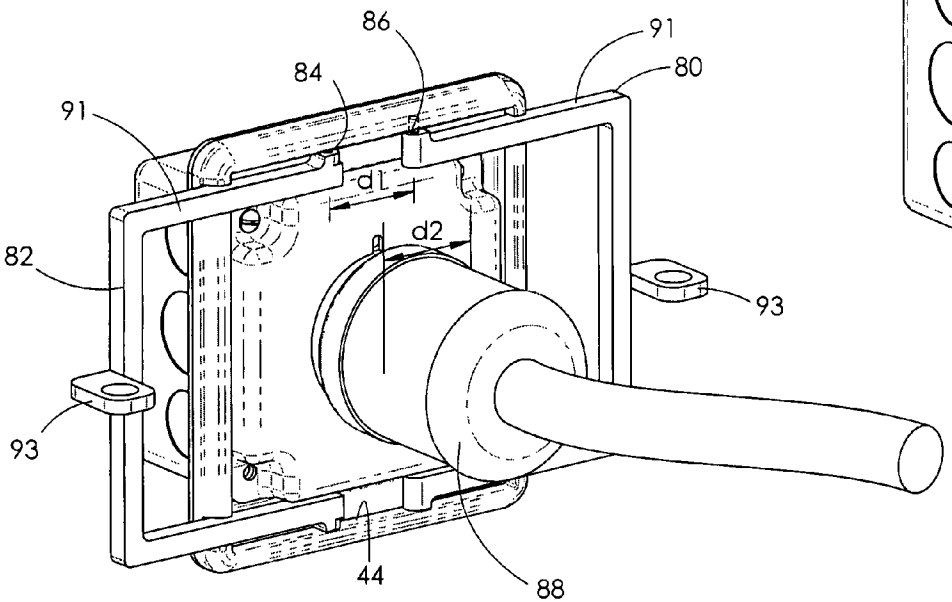
FIG. 14A is a perspective view of a junction box with a pair of U-shaped pivot lockout frames attached therewith.
Figure 15B:
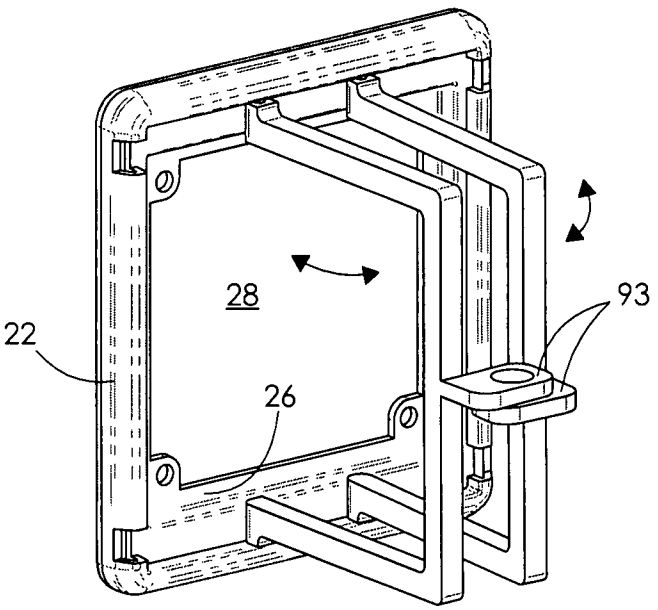
FIG. 15B is a perspective view of the U-shaped pivot assembly shown closed upon one another.
Figure 15A:
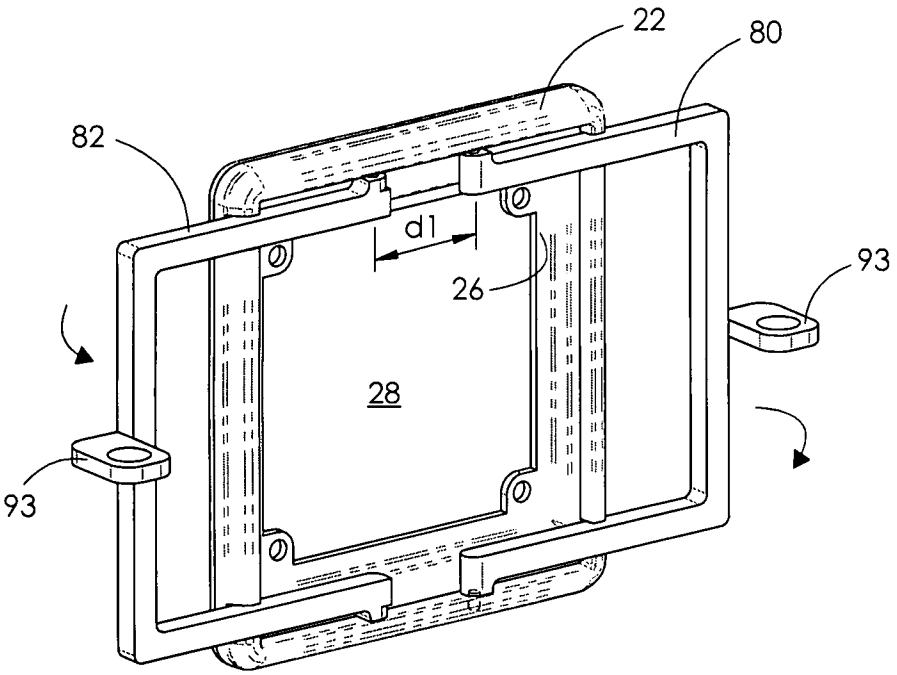
FIG. 15A is a perspective view of the frame and U-shaped pivot assembly shown in an open configuration.

FIG. 14A and FIG. 14B represent a further embodiment of the present invention wherein a pair of U-shaped pivotable lockout frame members 80 and 82 are pivotally attached to the shoulder portion 44. The representation shown in FIG. 14A has the U-shaped lockout frame members 80 and 82 opened 180° apart from one another. The distance between the respective pivot axes 84 and 86 is less than the diameter of the electrical plug 88 disposed into an electrical outlet 90. The diameter of a plug 88 which would mate into the outlet 90 is greater than the distance d1 between the pivot axes 84 and 86, so that when those U-shaped lockout frames 80 and 82 are rotated toward one another and locked together, they effectively prevent electrical plug 88 from being inserted into an outlet socket 90 within the assembly. The length of the arms 91 on the U-shaped lockout frame members 80 and 82 of course no longer than the diameter d2 of the electrical plug 88. Each of the U-shaped lockout frame members 80 and 82 preferably have a hasp 93 extending therefrom to enable a padlock 94 to be secured therethrough. FIGS. 15 A and 15 B shows a U-shaped frame members 80 and 82 without any electrical cords and plug therebetween, for clarity of viewing.

The invention claimed is:

1. A lockout frame arrangement for an electrical outlet box arrangement, which electric outlet box arrangement is arranged for receipt of electrical outlets, the lockout frame arrangement comprising:

a cover plate attachable to an open side of an electrical outlet box, to enable securement of electrical sockets therewithin;

a rectilinear outer-cover-capturing frame for securely being sandwiched between the cover plate and the open side of an electrical outlet box;

an outer protective cover plate matingly attached to and securable within a perimeter of the outer cover capturing frame.

2. The lockout frame arrangement as recited in claim 1, wherein the outer cover capturing frame has at least one hasp extending outwardly from a side portion thereof.

3. The lockout frame arrangement as recited in claim 1, wherein the outer cover capturing frame has a plurality of spaced apart notches in a shoulder portion thereof.

4. The lockout frame arrangement as recited in claim 3, wherein the outer protective cover has a pair of foot tabs extending therefrom on a first side.

5. The lockout frame assembly as recited in claim 4, wherein the outer protective cover has a hasp extending therefrom on a second side opposite from the first side.

6. The lockout frame assembly as recited in claim 1, wherein the outer protective cover has an inner surface shaped and the dimensioned so as to prevent mating of a plug with an outlet when that outer protective cover is secured in place on the outer cover capturing frame.

7. The lockout frame assembly as recited in claim 1, wherein the outer protective cover plate comprises a pair of U-shaped pivotable lockout frame members pivotally attached by spaced apart pivot axes, to an inside shoulder of the outer cover capturing frame.

8. The lockout frame assembly as recited in claim 7, wherein each of the U-shaped pivotable lockout frame members have a hasp on their outermost ends.

9. The lockout frame assembly as recited in claim 7, wherein the distance apart between adjacent spaced apart pivot axes is smaller than the diameter of an electrical plug to be utilized therewith.

10. The lockout frame assembly as recited in claim 1, wherein the cover capturing frame has a single hasp extending peripherally therefrom.

11. The lockout frame assembly as recited in claim 1, wherein the outer cover capturing frame has at least two hasps extending outwardly from different frame portions thereof.

12. The lockout frame assembly as recited in claim 11, wherein the different frame portions thereof are at a 90 degree angle with respect to one another.

13. The lockout frame assembly as recited in claim 1, wherein the rectilinear outer-cover-capturing frame securely sandwiched between the cover plate and the open side of an electrical outlet box has at least one outlet exposing opening therethrough.

14. The lockout frame assembly as recited in claim 1, wherein the rectilinear outer-cover-capturing frame is securable to the open side of a junction box and wherein the protective outer cover plate is mated to an inner periphery of the rectilinear outer-cover-capturing frame by a slot and engagement foot arrangement therebetween.

15. The lockout frame assembly as recited in claim 14, wherein the outer protective cover is enabled to be secured to the rectilinear outer-cover-capturing frame secured to the open side of a junction box in at least two orientations.

16. The lockout frame assembly as recited in claim 15, wherein the outer protective cover has one hasp and the rectilinear outer-cover-capturing frame has at least a pair of hasp members extending therefrom to enable the outer protective cover selective orientation thereof.

* * * * *